United States Patent [19]

Eastman

[11] Patent Number: 4,863,013

[45] Date of Patent: Sep. 5, 1989

[54] CONFORMAL PROTECTIVE SPECTACLE RECEPTACLE

[76] Inventor: Warren O. Eastman, 168 Riverview Dr., Guilford, Conn. 06437

[21] Appl. No.: 183,685

[22] Filed: Apr. 19, 1988

[51] Int. Cl.[4] ..... B65D 85/38

[52] U.S. Cl. ..... 206/5; 206/278

[58] Field of Search ..... 66/185; 2/158, 167, 2/170, 239, 241; 206/5, 5.1, 278; 150/154

[56] References Cited

U.S. PATENT DOCUMENTS

| | | | |
|---|---|---|---|
| 545,875 | 9/1895 | Burpee | 2/158 |
| 2,219,235 | 10/1940 | Morton | 2/239 |
| 2,498,202 | 2/1950 | Dingman | 206/5 R |
| 2,554,630 | 5/1951 | Miller | 206/5 R |
| 2,739,698 | 3/1956 | Baratelli | 206/5 R |
| 2,778,027 | 1/1957 | Bacon | 2/170 |
| 3,819,033 | 6/1974 | Hueber | 206/5 R |

*Primary Examiner*—Jimmy G. Foster

*Attorney, Agent, or Firm*—Ostrager & Chong

[57] ABSTRACT

A lightweight washable reversible conformal spectacle receptacle which increases any primary dimension of the spectacles by no more than the thickness of the material is provided. The receptacle can comprise an envelope of woven material and can include a wall retention member and one or more end closures which can be refastenable.

35 Claims, 2 Drawing Sheets

CONFORMAL PROTECTIVE SPECTACLE RECEPTACLE

This application is related to spectacles and more particularly to a lightweight washable reversible protective conformal spectacle receptacle which increases any primary dimension of the spectacles by no more than the thickness of the material.

BACKGROUND

Spectacles, when not in use and unprotected are prone to being scratched or damaged. Currently available spectacle cases suffer from a variety of deficiencies which tend to deter an eyeglass owner from using these cases to protect their glasses when they are not in use. Case size is probably the most significant drawback. Currently available cases are large and bulky. The cases are rigid and are intended to protect the glasses against impact as well as scratches. The spectacle wearer in addition to wearing eyeglasses is required to also carry a large bulky case to properly store and protect the glasses when they are not in use. The case is usually attached to a pocket by a large clip. The case thus fits awkwardly in any pocket and a user may choose to avoid the awkwardness by not using the case. It is common for a spectacle user to be without a glass case and for the spectacle to be left unprotected when not in use. The spectacles are often placed unprotected in a shirt or blouse pocket for convenient access and can fall easily out onto the floor or ground when the wearer bends or stoops.

Presently available cases are commonly made of a rigid material such as leather and are lined with a soft padding. Cases of this type are necessarily substantially larger than the maximum dimension of the spactacles enclosed therein. These cases can not be washed or readily cleaned and thus foreign matter can be retained within the case and as spectacles are inserted within the case, the lens may become scratched.

Examples of such a bulky cases can be found in prior patents. For instance U.S. Pat. No. 2,739,698 to Baratelli for a Spectacle Case discloses a case having two separate wall sections each comprised of an inner stiffening member which provides a fixed and rigid form for the case. U.S. Pat. No. 177,415 discloses a case shaped as a portion of a conic section having two open ends and made slightly larger at the upper than the lower end such that the spectacles can be readily inserted and not allowed to fall through. U.S. Pat. No. 2,650,700 discloses a cushioned eyeglass case having a single mouth formed of two outer sheet elements fashioned from a fairly thin and highly pliant and flexible suede leather and an inner lining of cotton, flannel, flannelette or cotton felt. U.S. Pat. No. 2,762,499 discloses a spectacle case having a tubular body portion formed by reversely folding a piece of flexible sheet material such as leather or plastic and securing the opposite ends to form a pocket closed at one end. A portion of the open end is cut away and an elastic member is provided in place therof. U.S. Pat. No. 3,036,697 discloses a case constructed of a sheet of pliable material such as leather and having a frame bar placed along the medial portion of the sheet. U.S. Pat. No. 3,559,798 discloses a floatable glass case made of a sheet of flexible and strechable closed cellular elastomeric material such as polychloroprene synthetic rubber which is sealed to itself on three sides to form a pocket open on one end. U.S. Pat. No. 3,819,033 discloses an expandable spectacle case formed with of a rigid outer shell made partially flexible by introducing slots therein. The case is closed on three sides is shaped like a pocket with an inner lining of elastic material such as soft knit fabric surrounded by an outer covering of felt, suede or the like. U.S. Pat. No. 4,267,923 discloses an open ended eyeglass case including a temple separator and indicates that the case can be a hard rigid case or a soft flexible case constructed of materials such as plastic, leather, cloth or the like.

These prior bulky cases do not closely conform to the exterior configuration of the spectacles and thus significantly increase the exterior dimension of the case and increase its awakwardness. Further these cases can not easily cleaned by for instance machine washing. Thus an unfulfilled need for a lightweight, washable, conformal and flexible spectacle receptacle exists.

SUMMARY OF THE INVENTION

It is an object of the present invention to provide a simple spectacle receptacle which is easy and convient to use. The simplicity and convenience of this receptacle promotes greater use and consequently reduces spectacle lens damage.

It is also an object of the present invention to provide a very low cost spectacle receptacle which can be made a part of the initial purchase and which can be inexpensively acquired if multiple receptacles or replacements are required.

It is recognized that many eyeglass wearers are employed in office type settings where it is unlikely that a given pair of spectacles will experience a damaging impact. The use of high strength plastics in the frames and lens of currently available spectacles, further reduces the likelyhood that a given pair of eyeglasses will suffer terminal damage from impact. While dropping a pair of spectacles is certainly an inconvenience, simply dropping the spectacles is unlikely to damage the lens or frames particularly if these are made of plastic. Consequently most present day spectacle damage is attributable to lens scratches which occur while the eyeglasses are not in use and are not properly stored in a protective case. Scratches can occur from abrasion or from the improper cleaning of a dirty lens which became soiled when it was left unprotected. Accordingly, in many instances, it is more desireable to protect unused eyeglases against damage from dirt and abrasion and it is less necessary to protect unused eyeglases against damage from severe impact. It is therefore an object of the present invention to provide a lightweight, washable, conformal and flexible spectacle receptacle which provides protection against common lens damage with a miminum increase in spectacle dimension and which will prevent the protected spectacles from falling out of the pocket.

Therefore a new, unburdensome simple and open ended conformal spectacle receptacle is provided to Overcome the deficiencies of presently available spectacle cases. The case is lightweight and completely collapseable. When not in use the case can be easily folded upon itself to convieniently fit in any pocket such as a shirt or pants pocket without a creating a bulging appearance. In addition the proposed receptacle is inexpensive and a spectacle wearer can easily afford several of these receptacles and can for instance keep an extra one at work, another at home, a third in the car and so on. In addition the receptacle is preferrably reversible to be turned inside out and made of a washable material to enable the user to clean and remove foreign matter threrfrom and therby avoid introducing lens scratches. With the receptacle of the present invention it less likely that the spectacle wearer will be without an appropriate spectacle receptacle and thus it is less likely that the spectacles will become damaged from minor abuse such as scratches or improper cleaning.

A spectacle receptacle in accordance with the present invention preferrably comprises a flexible envelope of unitary construction having at least one open end for conformally engaging and retaining spectacles therein whereby the spectacles are completely protected and any primary dimension of the spectacle is increased by no more than the thickness of the envelope material. The envelope preferrably configured as a sleeve closely conforms to the exterior surface of the spectacles. A wall retention means can be disposed approximately midway along the length of the envelope for locally restricting the cross sectional area of the envelope to enhance retention and conformality to promote frictional engagement between the spectacles and the envelope. The retention means expands to accept the spectacles and contracts to force engagement between the envelope and a portion of said spectacle. The envelope can be open at either or both ends with the opening at each end being of a size sufficient to receive a pair of spectacles therethrough. The case can be fabricated from a lightweight flexible washable material such as a woven knitted natural or synthetic or material. The envelope can also be made from a flat sheet with opposed ends being fastening together by sewing or similar mechanism for forming a tube-like envelope thereof. The retention means can comprise a tightly woven portion or a material of greater elasticity. When not in use the receptacle can collapse into a substantially flat sheet which preferrably can be folded upon itself one or more times.

Futher objects, features and advantages of the present invention will become apparent to those skilled in the art from consideration of the enclosed specification when taken in conjunction with the appended drawings in which.

Figure 5:
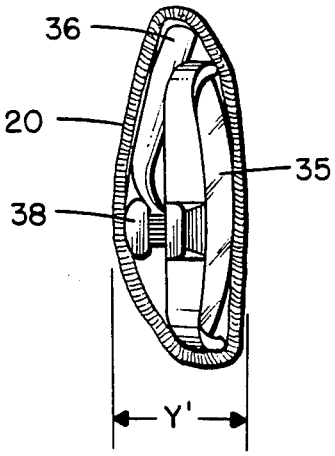
Figure 6:
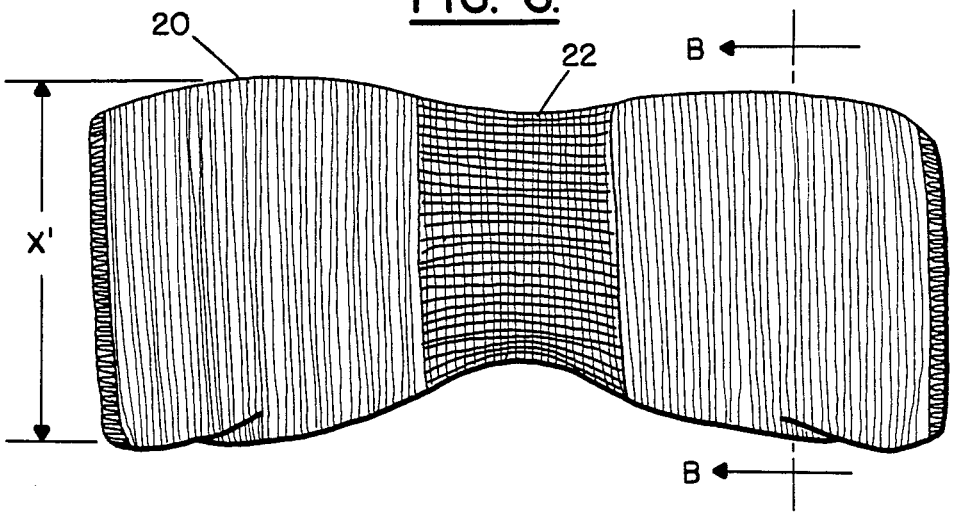

FIG. 5 is an illustration of an end view taken along lines B—B of FIG. 6 of a typical pair of spectacles which might be inserted within a receptacle fabricated in accordance with the present invention and FIG. 6 is an illustration of a preferred embodiment of a spectacle receptacle in accordance with the present invention in which a pair of spectacles have been inserted and the envelope has become conformingly distorted.

Figure 7A:
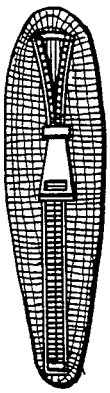
Figure 7B:
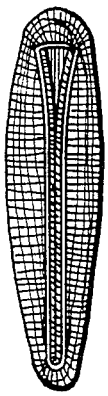
Figure 7C:
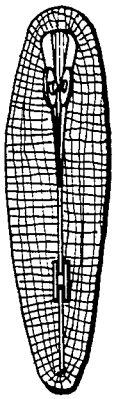

FIGS. 7A, 7B and 7C illustrate an end view of a spectacle receptacle in accordance with the present invention having a zipper type end closure as is shown in FIG. 7A, a Velcro type end closure as shown in FIG. 7B and a snap type end as is shown in FIG. 7C.

DETAILED DESCRIPTION

Figure 1:
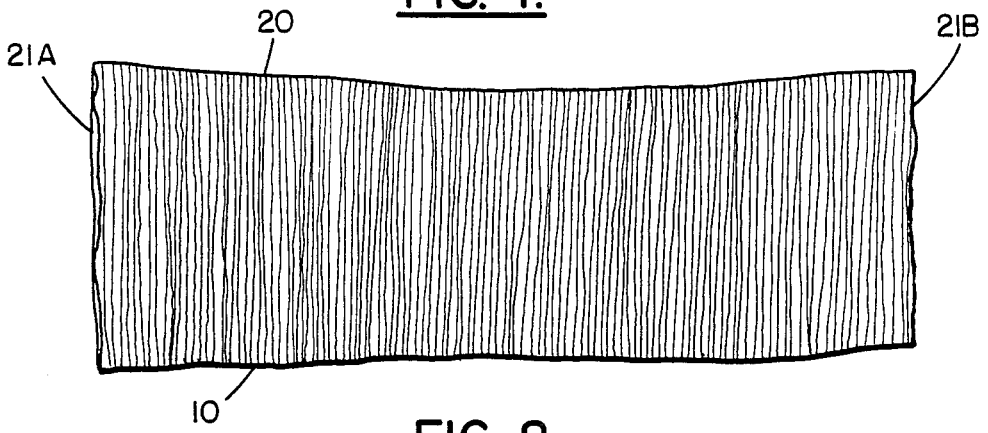
FIG. 1 is an illustration of a first embodiment of a spectacle receptacle in accordance with the present invention.

A further appreciation of the present invention can be obtained from consideration of the figures and in particular FIG. 1 therof which illustrates a spectacle receptacle 10 in accordance with a first preferred embodiment of the present invention. The spectacle receptacle 10 can comprise an envelope 20 formed from a tube of fibrous woven material open at either or both ends 21A and 21B. In an another embodiment, the envelope 20 can be formed from a sheet of material wherein opposite ends of the sheet can be secured together in a single seam by for instance sewing to form a flexible tube like sleeve structure open at both ends for receiving a pair of spectacle therein. Alternately either end 21A or 21B of the spectacle receptacle 10 can be sewn closed to from a sack like structure to allow for spectacle insertion a vertically downward direction. In a still further embodiment opposed sides of either or both ends of the envelope can be outfitted with an end closure such as the tightly woven end portion illustrated in FIGS. 1 and 2 as a tapered or restricted end. Alternatively a refasenable means such as a Velcro type material (FIG. 7B), snaps (FIG. 7C) or a zipper (FIG. 7A) can be provided as an end closure.

It is preferred that the envelope 20 be formed of a stretchable or elastic flexible material. A knitted natural or synthetic material such as a wool, cotton or polyester type material including blends thereof is preferred. The material can be allowed to expand to accept the spectacle and to thereafter contract to conformally engage the inserted spectacles.

Figure 2:
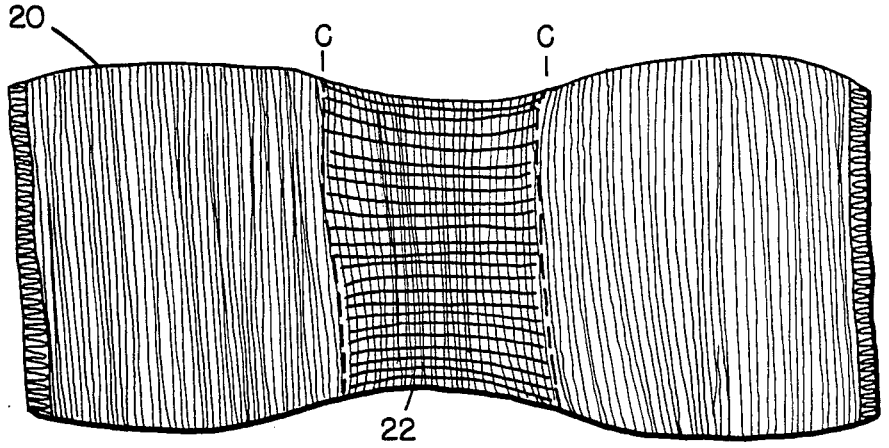
FIG. 2 is an illustration of a an alternate preferred embodiment of a spectacle receptacle in accordance with the present invention.

A still further preferred embodiment of the spectacle receptacle 10 is shown in FIG. 2 in which the envelope 20 includes wall retention means 22 shown as a section of the envelope between lines C—C of FIG. 2. The section 22 can surround and engage the spectacles through its own elasticity. The retention section 22 can be woven intergal with the material of the envelope 20 to form an intergral and elasticly restricted portion. The wall restriction means 22 is positioned proximate the intended final position of the neck/nose bridge 32 of the spectacle frame when inserted within the envelope. The wall retention means 22 can comprise a tightly woven portion and include elastic material woven therein. The conformality of the section 22 forms a mechanical lock between the envelope and the inserted frame. Further details of the section 22 will be evident FIG. 6 below.

Figure 3:
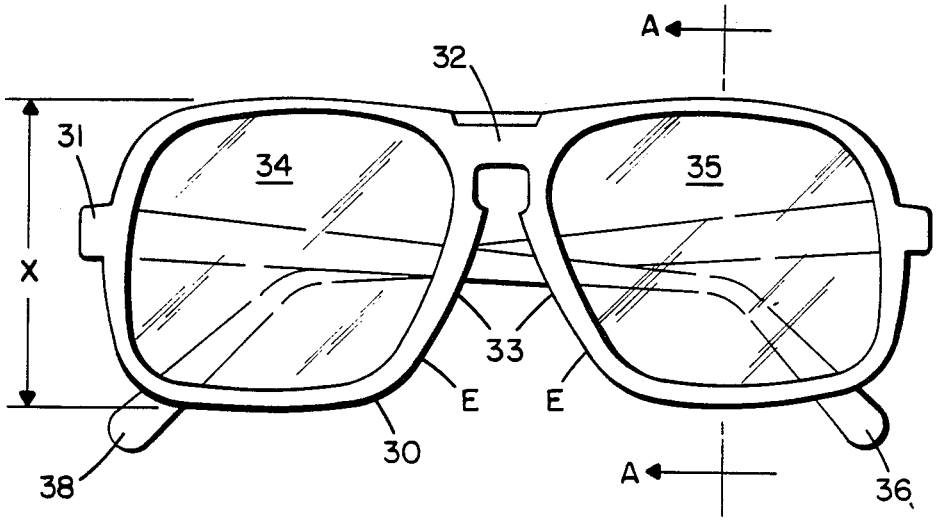
FIG. 3 is an illustration of plan view of a typical pair of spectacles which might be inserted within a receptacle fabricated in accordance with the present invention.
Figure 4:
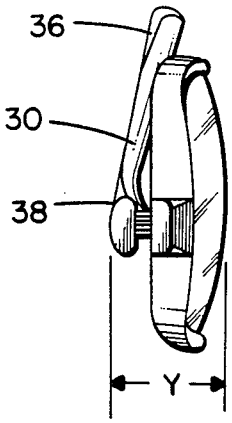
FIG. 4 is an illustration of an end view taken along lines A—A of FIG. 3 of a typical pair spectacles which might be inserted within a receptacle fabricated in accordance with the present invention.

Referring now to FIG. 3, an illustration of a typical pair of spectacles 30 such as might be inserted within the spectacle receptacle 10 of the present invention is shown in collapsed position. The spectacles 30 comprise a frame 31 having nose bridge 32 interconnecting two lens holders 33 shaped to receive first and second convex lenses 34 and 35 therein. Two arms 36 and 38 are hingedly attached to the rear of the lens holders 33. The arms are shaped to engage the rear of an ear and in combination with the nose bridge, hold the spectacles on the face of the wearer. As shown the spectacles have two primary dimensions. In the area of th lens, the frame 31 has a first vertical dimension or height X measured across the face of lens 34 and from the exterior surface of the opposed frame portions immediately surrounding the lens. A second primary dimension Y is illustrated as the spectacle depth relative to the collapsed spectacles shown in FIG. 4 and is illustrated to extend from the outside surface of the temple arms 36 and 38 to the convex outer surface of the lens 35.

Referring now to FIGS. 5 and 6 together, an illustration of an enclosed pair of spectacles 30 is shown. FIG. 5 provides an end view of the enclosed spectacles taken along lines B—B of FIG. 6. The depth Y' of the spectacle receptacle 10 is measured from the exterior surface of the envelope 20 covering the front of face of the lens 35 to the rear surface of the envelope covering the rear surface of the arms 36 and 38. As shown in FIG. 6, the receptacle height X' is measured across the face of lens 35 from the exterior of the covered surface of the opposed frame portions immediately surrounding the lens 35. The conformal spectacle receptacle 10 of the present invention closely adheres to the spectacles and increases the primary dimensions height X and depth Y of the spectacles 30 by no more than the thickness of the material.

The envelope 20 can be open at either or both of its opposite ends. As the spectacles 30 are inserted, the envelope 20 can reconfigure as necessary and can expand to accept the spectacles 30. Once the spectacles 30 have been inserted within the envelope 20 the envelope 20 can conformally contract to frictionally engage the frame 31 of the spectacles 30. The envelope contracts and closely conforms to the surface of the lenses 34 and 35 and to the frame 31. The wall retention means 22 can assist the envelope 20 in conformally adhering to the spectacles 30 by locally contracting the envelope 20 in the area of the neck bridge and the cross over of the arms 36 and 38. The wall retention means 22 can form a mechanical lock between the envelope 20 and the spectacles 30 and more particularly the portion of the lens holders 33 labeled E in FIG. 3 and being the lower inside corner of the frame 31 and being situated next to the base of the wearers nose.

A broad variety of currently available materials such as yarns, threads, filaments and composites when used in combination with any of a number of production processes, will allow the receptacles 10 to be construted with a broad range of different attributes such as friction, elasticity, design, color, decoration and monograms or initials.

While many of the structural attibutes and features of the conformal spectacle receptacle 10 have been described heretofore, the improved functional achivements also are to be appreciated. The material can selected to provide a high frictional surface to prevent slipage between the envelope 20 and the spectacles 30 as well as between the receptacle 10 and a shirt pocket. The material and the construction of the envelope 20 can be selected to strike a balance between easy insertion and removal and sufficient retention strength. A cotton or polyester material woven in a tube like configuration works well. The material is preferrebly naturally elastic to impart conformality to the envelope 20 and to enhance the friction between the surfaces of the spectacles 30 and the envelope 20. The material can conform to the spectacles 30 and contact a maximum surface area of the spectacles 30 to further enhance the frictional engagemennt between the envelope 20 and the spectacles 30. The conformality of the envelope 20 in the area of the nose bridge of a pair of enclosed spectacles creates a mechanical lock between the spectacles 30 and the envelope 20 to prevent dislodgement of the spectacle 30 from the receptacle 10. Further the mass of the receptacle 10 is minimal when comapared to the mass of the spectacles 30 and thus receptacle 10 is unlikely to unilaterally dislodge from the spectacles 30.

While a preferred embodiment of the conformal spectacle receptacle 10 of the present invention has been shown and described it will be appreciated by those skilled in the art that this disclosure is made by way of example and is not intended to limit the scope of the present invention. The envelope 20 can be produced by various processes including knitting, weaving and crocheting. The envelope material can be produced from yarns, threads and filaments of natural or synthetic fibers as well as composites thereof can be employed in combination with production techniques to provide broad variation of receptacle attributes such as friction, elasticity, conformality, design, color, decoration and identification. Thus the scope of patent protection afforded the present invention is determined only by the appended claims.

What is claimed is:

1. A receptacle for enclosing and protecting spectacles comprising:

a pair of spectacles having a height and a depth, a flexible envelope of unitary construction open at both ends conformally engaging and retaining said spectacles therein whereby the spectacles are substantially protected from dirt, abrasion and scratches and height and depth of the spectacles is increased by no more than the thickness of the envelope material.

2. The receptacle of claim 1 wherein said envelope closely conforms to exterior surfaces of said glasses.

3. The receptacle of claim 1 wherein said envelope includes an integral wall retention means disposed approximately midway along the length of said envelope for locally restricting a cross sectional area of said envelope proximate a neck bridge region of an enclosed pair of spectacles to enhance retention and conformality to promote contact and frictional engagement between said envelope and said spectacles.

4. The receptacle of claim 3 wherein opposite ends of said envelope comprise tightly woven restricted portions.

5. The receptacle of claim 3 wherein said envelope comprises a woven fibrous construction and provides an enhanced friction outer surface to prevent slippage of retained spectacles from a pocket.

6. The receptacle of claim 3 wherein said wall retention means expands to accept said spectacles and contracts to establish engagement between said retention means and a portion of said spectacle.

7. The receptacle of claim 3 wherein said wall retention means comprises a tightly knitted portion.

8. The receptacle of claim 3 wherein said wall retention means comprises a material of greater elasticity.

9. The receptacle of claim 1 wherein said envelope comprises a lightweight washable material having a tube-like construction.

10. The receptacle of claim 1 wherein said envelope comprises a knitted or woven material.

11. The receptacle of claim 1 wherein said envelope comprises a flat sheet having opposed ends fastened to form a tube-like envelope.

12. The receptacle of claim 1 wherein said envelope is devoid of rigid support.

13. The receptacle of claim 1 wherein said envelope is reversible.

14. A receptacle for spectacles comprising:

a flexible envelope of unitary construction open at both ends conformally engaging and retaining spectacles therein whereby the spectacles are substantially protected from dirt, abrasion and scratches and increases spectacle height and depth by no more than the thickness of the envelope material, said envelope including an end closure selected from the class comprising Velcro tape, zippers and snaps.

15. The receptacle of claim 14 wherein said envelope closely conforms to exterior surfaces of said glasses.

16. The receptacle of claim 1 wherein said envelope includes an integral wall retention means disposed approximately midway along the length of said envelope for locally restricting a cross sectional area of said envelope proximate a neck bridge region of an enclosed pair of spectacles to enhance retention and conformality to promote contact and frictional engagement between said envelope and said spectacles.

17. The receptacle of claim 16 wherein said wall retention means expands to accept said spectacles and contracts to establish engagement between said retention means and a portion of said spectacle.

18. The receptacle of claim 16 wherein said wall retention means comprises a tightly knitted portion.

19. The receptacle of claim 16 wherein said wall retention means comprises a material of greater elasticity.

20. The receptacle of claim 14 wherein said envelope comprises a lightweight washable material having a tube-like construction.

21. The receptacle of claim 14 wherein said envelope comprises a knitted or woven material.

22. The receptacle of claim 14 wherein said envelope comprises a flat sheet having opposed ends fastened to form a tube-like envelope.

23. The receptacle of claim 14 wherein said envelope is devoid of rigid support.

24. A combination including spectacles together with a receptacle for enclosing and protecting said spectacles wherein said receptacle comprises a flexible envelope of unitary tube-like construction open at both ends for conformally engaging and retaining spectacles therein whereby the spectacles are substantially protected from dirt, abrasion and scratches, said envelope including an integral wall retention means disposed approximately midway between said ends along the length of said envelope locally restricting a cross sectional area of said envelope proximate a neck bridge region of said enclosed spectacles to enhance retention and conformality to promote contact and frictional engagement between said envelope and said spectacles.

25. The combination of claim 24 wherein said envelope increases the height and depth of the spectacles is increased by no more than the thickness of the envelope material.

26. The receptacle of claim 24 wherein said wall retention means expands to accept said spectacles and contracts to establish engagement between said retention means and a portion of said spectacle.

27. The receptacle of claim 24 wherein said wall retention means comprises a tightly knitted portion.

28. The receptacle of claim 24 wherein said wall retention means comprises a material of greater elasticity.

29. The receptacle of claim 24 wherein said envelope comprises a lightweight washable material having a tube-like construction.

30. The receptacle of claim 24 wherein said envelope comprises a knitted or woven material.

31. The receptacle of claim 24 wherein said envelope comprises a flat sheet having opposed ends fastened to form a tube-like envelope.

32. The receptacle of claim 24 wherein said envelope is devoid of rigid support.

33. The receptacle of claim 24 wherein said envelope is reversible.

34. The receptacle of claim 24 wherein said envelope comprises a woven fibrous construction and provides an enhanced friction outer surface to prevent slippage of retained spectacles from a pocket.

35. The combination of claim 24 wherein each end of said envelope includes an end closure comprising a tightly woven restricted portion.

* * * * *